US006027103A

United States Patent [19]

Painter

[11] Patent Number: 6,027,103

[45] **Date of Patent: *Feb. 22, 2000**

[54] POWERHEAD ASSEMBLY AND HOISTING SYSTEM

[76] Inventor: Byron Wayne Painter, 110 N. Rhododendron Dr., Port Townsend, Wash. 98368

[ * ] Notice: This patent issued on a continued prosecution application filed under 37 CFR 1.53(d), and is subject to the twenty year patent term provisions of 35 U.S.C. 154(a)(2).

[21] Appl. No.: 08/812,929

[22] Filed: Mar. 3, 1997

[51] Int. Cl.[7] ..... B66D 1/12; B66D 1/30

[52] U.S. Cl. ..... 254/332; 254/362; 254/374

[58] Field of Search ..... 254/362, 371, 254/372, 374, 332

[56] References Cited

U.S. PATENT DOCUMENTS

| | | | |
|---|---|---|---|
| 3,473,922 | 10/1969 | Wood et al. | 254/362 |
| 3,722,126 | 3/1973 | Whipple et al. . | |
| 3,765,614 | 10/1973 | Bartl et al. . | |
| 3,819,155 | 6/1974 | Smith | 254/371 |
| 3,836,120 | 9/1974 | Niskin | 254/371 |
| 3,942,655 | 3/1976 | Anderson . | |
| 4,165,830 | 8/1979 | Svendsen . | |
| 4,234,164 | 11/1980 | Ruark . | |
| 4,354,667 | 10/1982 | Svendsen | 254/371 |
| 5,271,608 | 12/1993 | Kubono | 254/372 |
| 5,522,582 | 6/1996 | Dilks | 254/362 |

OTHER PUBLICATIONS

Brothers Welding Sales Pamphlet: Home of Lil'Aud Pot Pullers, 1–96—no date available.

Pacific Industrial Supply: Catalog Excerpt, Hydroslave Pot Haulers, p. 24—no date available.

*Primary Examiner*—Katherine Matecki

*Attorney, Agent, or Firm*—Ann W. Speckman; Janet Sleath

[57] ABSTRACT

An electrically powered hoisting system is operated by seating a line attached to the load to be hoisted in a groove formed between two sheave components and activating the electrical drive motor to rotate the sheave assembly. Voltage for the electrical drive motor is provided by an on-board 12 volt battery and voltage to the drive motor is controlled by means of a switch device. The groove formed by the sheave components has a resilient gripping surface that provides a firm line gripping action and hands-free and self-tailing operation. A davit, davit mounting brackets, and a flexible mounting assembly for mounting the powerhead assembly to a support are also disclosed.

17 Claims, 5 Drawing Sheets

Fig. 4A
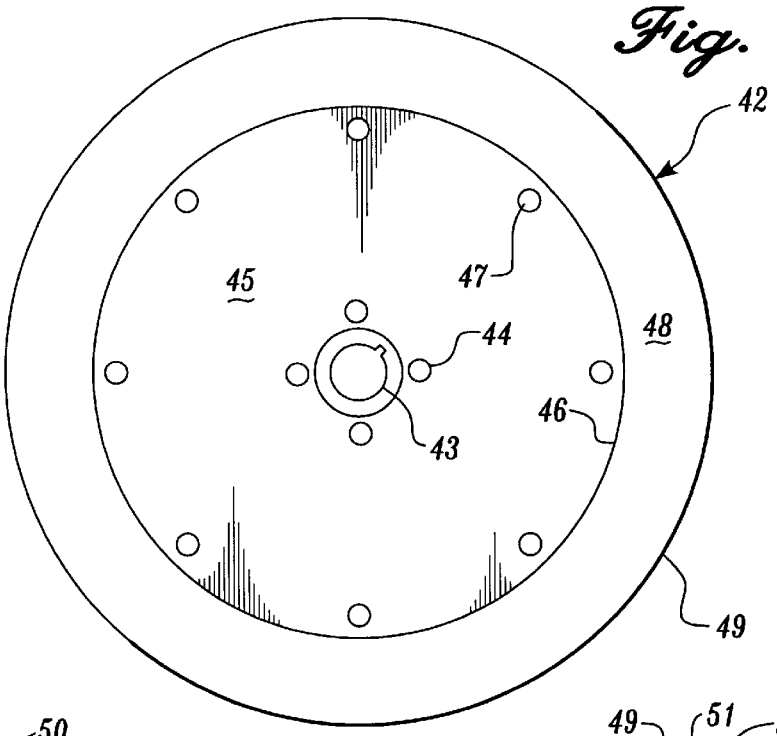
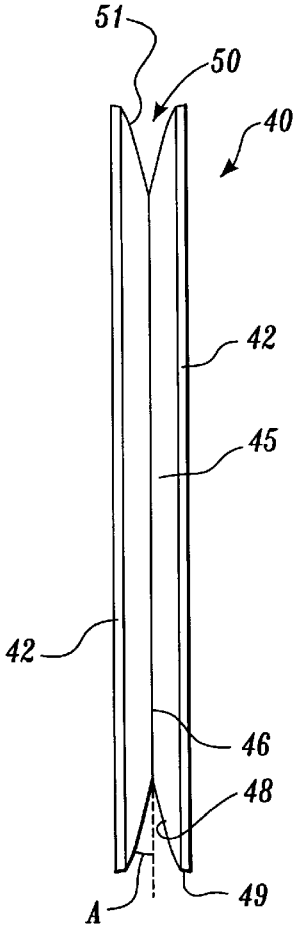
Fig. 4B
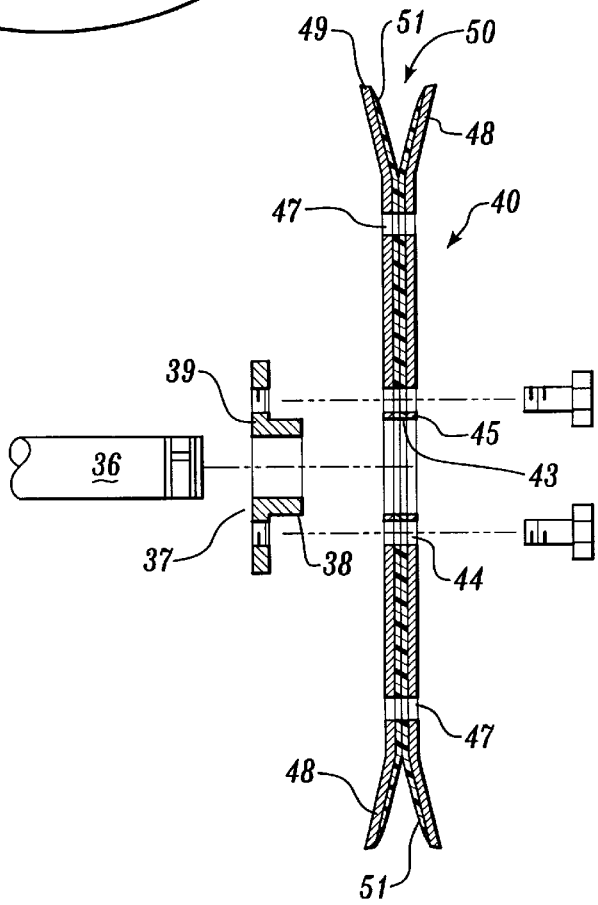
Fig. 4C

Fig. 7
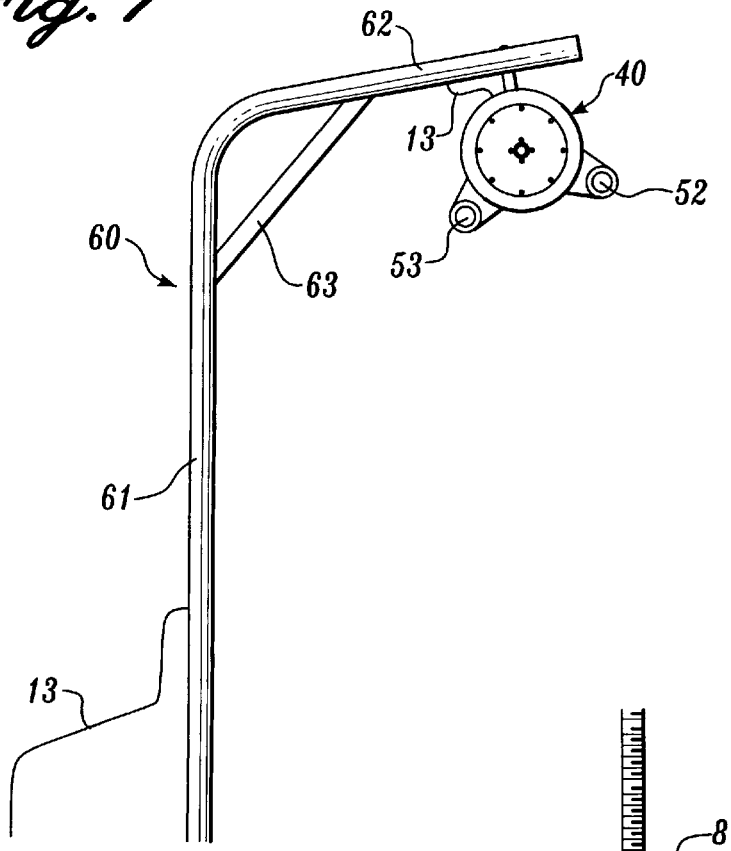
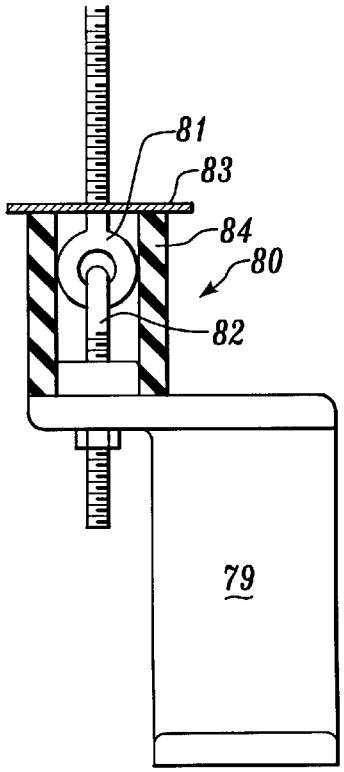
Fig. 8

POWERHEAD ASSEMBLY AND HOISTING SYSTEM

FIELD OF THE INVENTION

The present invention relates generally to systems for hoisting loads, and relates more specifically to hoisting systems for use in marine environments for raising loads attached to a line.

BACKGROUND OF THE INVENTION

Several types of marine hoisting systems are in common use for retrieving loads such as crab and shrimp pots, lobster traps, and the like from marine environments. Such hoisting systems generally utilize some type of a rotating shaft such as a capstan, roller or sheave assembly around which a line is lead for retrieval. Safety, reliability and convenience are important factors.

One type of hoisting system utilizes a gasoline-powered engine having a gear reduction unit that rotates a capstan drive. The line is wrapped several times around the capstan, and hoisting friction is obtained by maintaining constant tension on the free end of the line. This system requires constant operator involvement. One of the serious safety deficiencies of this type of gasoline engine-powered hoisting system is that the capstan can be stopped only by shutting off the engine. Despite constant attention from an operator, the line frequently becomes tangled as it is retrieved. Because the capstan cannot be easily turned off in an emergency situation, many operators panic and grab at the entangled line, while the capstan continues to rotate, resulting in serious injury. Lead weights, which may be attached at intervals on the lines, also tend to hit the block leading to the capstan and fly off unpredictably, sometimes injuring the operator.

Gasoline engine powered hoisting systems are difficult to refuel, particularly when the vessel is on the water. Gasoline spills may cause fires or explosions, and both spills and exhaust pollute the environment. Moreover, operation of gasoline-powered auxiliary engines requires regular maintenance, is noisy during operation, produces unpleasant exhaust, and generally do not provide reliable starting. Typical gasoline engines also quickly corrode, particularly during exposure to marine salt-water environments.

Hydraulic hoisting systems generally provide safer operation than the gasoline-powered systems, but they require installation of a hydraulic pump on the vessel, with the associated hydraulic lines, valves, and the like. Hydraulic systems require a substantial initial investment, are heavy, and have substantial maintenance requirements. Hydraulic hauling systems are well suited to larger, commercial vessels, but are too costly and heavy for smaller, recreational and light commercial applications.

U.S. Pat. No. 4,234,164 discloses a gasoline motor powered crab pot hauling system utilizing a specialized sheave assembly. The sheave comprises a pair of separated flywheels having wear resistant replaceable sheave inserts. The replaceable inserts are corrosion and wear resistant, and can be made of a light weight and inexpensive material. The inserts may be made of stamped stainless steel, cast iron or a thermosetting plastic such as phenolic [sic]. The sheave inserts are disc-like and frusto-conical in shape and abuttingly engage and form a groove for receiving the line to be hauled. This approach requires the use of a line separator or stripper to separate the line from the running bight of the sheave.

U.S. Pat. No. 4,165,830 discloses a crab pot warp line coiler. The hauling block is suspended from a davit projecting outwardly from a location above the rail of a vessel and comprises a sheave rotated by a hydraulic drive source with fairlead sheaves leading the pot line toward and away from the drive sheave. The drive sheave has a deep V-groove for wedgingly receiving the pot line. A shock absorber is provided between the davit and the hauling block to stabilize the hauling block and provide the desired degree of alignment, while allowing the hauling block to have some freedom of motion.

U.S. Pat. No. 3,765,614 discloses a hydraulically operated line hauling and coiling apparatus in which line is passed through a fairlead mechanism to a V-shaped groove in the drive sheave. The line is then stripped from the drive sheave and conveyed to the coiling system.

U.S. Pat. No. 3,722,126 discloses a marine hauling apparatus in which a gangion block is positioned over the side of the vessel and mounted with a rotational joint for continuously lifting line from the sea. The block has two identical sheave members mounted on a frame for independent rotation about a common axis. Each of the sheave members has a peripheral surface flared radially from an inner rim edge to an outer rim edge, the flare forming a conical surface. The sheave members are mounted in face-to-face relationship to form a peripheral groove between the two flared surfaces with a clearance space between the inner rim edges. A second gangion block on the vessel receives the line from the first block and uniformly positions both the line and the harvesting devices suspended from it for further handling on the vessel.

U.S. Pat. No. 3,942,655 discloses a lobster trap davit for hoisting lobster traps from water onto a gunnel of a lobster boat. The hoist arm of the davit is adjustable and is pivotable in a vertical plane. The davit may be operated using electrical, hydraulic or pneumatic means.

Although numerous marine hauling systems are known in the art, as evidenced by the patents described above, none of them provides convenient, safe operation for recreational and light commercial applications.

SUMMARY OF THE INVENTION

The hoisting system of the present invention is mountable on a support mounted to the gunnel and/or deck of a marine vessel to provide safe, reliable and controllable hoisting of a load by retrieving a line attached to the load. Various types of loads such as crab, shrimp, lobster and crayfish pots, fish on long lines, various loads requiring retrieval in diving operations, and the like, may be safely hoisted using the hoisting system of the present invention. The safety features and simplicity of operation render the hoisting system of the present invention especially suitable for use by recreational and light commercial users.

The hoisting system is preferably electrically powered and is operated by seating the line in a groove formed between the two opposing sheave components and activating a switch to start the electrical drive motor and rotate the sheave asssembly and retrieve the line. The unique properties of the sheave assembly provide line retrieval without requiring operator intervention or participation once the line has been seated in the sheave assembly, and the retrieved line is self-tailing. This hoisting system is especially suitable for recreational and light commercial marine hoisting applications and provides simplified and safe operation.

The powerhead assembly of the hoisting system preferably comprises an electrical drive motor, a gear reduction unit that converts the high rotational output of the electric motor to a slower rotation, higher torque output, and a sheave assembly that is rotated by the output shaft of the gear reduction unit. Utilization of an electrical drive motor in the hoisting system eliminates the refueling and environmental hazards of gasoline-powered systems, and provides quiet and controllable operation. The hoisting system can be turned on and off using appropriate switch devices to regulate voltage to the drive motor.

Voltage for the electric drive motor is preferably provided from an on-board battery, such as a 12 volt battery that powers the vessel engine or auxiliary electrical needs. According to preferred embodiments, an on-board 12 volt battery source is electrically connected to and activates a 4 pole permanent magnet 12 volt DC electrical drive motor in the hoisting powerhead assembly. Voltage to the drive motor may be controlled using switch devices, such as a drum switch, a solenoid switch, or a rocker switch. Reversing the polarity of the applied voltage results in a reversal of the direction of rotational output and provides rotation of the sheave assembly in "reverse." According to preferred embodiments, voltage to the drive motor is controlled such that the hoist can be selectably operated in forward, hold, and reverse conditions.

The sheave assembly is an important feature of the hoisting system of the present invention. The sheave assembly preferably comprises two disc-like sheave components having a planar interface surface and an angular rim. Two sheave components are fastened to one another in a mirror image arrangement to form a groove between the angular rims in which line is led for retrieval. At least the angular rim of each sheave component is provided with a resilient gripping surface comprising, for example, a synthetic rubber material such as neoprene. The friction provided by the hard rubber surface forming the groove and the precise angle created by the juxtaposition of angular grooves act upon the line being hoisted to provide a firm gripping action and hands-free operation. The sheave assembly of the present invention is self-tailing and does not require a splitter mechanism to separate the line from the sheave. The sheave assembly can reliably hoist line of various compositions, types and diameters.

The powerhead assembly is preferably mounted to a support that suspends the powerhead assembly over the side of a vessel or other platform when it is in operation. One suitable support is a rigid davit configured and mounted to suspend the powerhead assembly over the side of a vessel at or slightly above eye level of the operator and such that the load clears the side of the vessel during hoisting operations. The davit is preferably mounted to or through the vessel gunnel and may additionally be mounted in a bracket installed on or near the vessel deck. A locking pin may be provided in one or more of the mounting brackets to secure the davit in a stationary condition and prevent rotational and axial movement. The powerhead assembly is preferably mounted to the davit or an alternative support structure using a flexible mounting assembly that permits the powerhead assembly to swivel rotationally on a substantially horizontal plane and also permits a limited degree of side swing movement.

The hoisting system of the present invention has numerous safety features and is easy and convenient to operate. It may be conveniently stored, transported, installed and removed, and it requires little maintenance.

BRIEF DESCRIPTION OF THE DRAWINGS

Preferred embodiments of the hoisting system of the present invention will be described below in detail with reference to the Figures, in which:

FIG. 4A shows a front view of a sheave component of the present invention;

FIG. 4B shows a side view of a sheave assembly of the present invention comprising two sheave components mounted in a mirror image relationship;

FIG. 4C shows an exploded side view illustrating the attachment of two sheave components to form a sheave assembly and the mounting of the sheave assembly to the gear reduction unit output shaft;

FIG. 7 shows a side view of davit designed for heavy duty applications having a sheave assembly incorporating a roller fairlead; and FIG. 8 shows a broken away view of the flexible mounting system of the present invention for mounting the powerhead assembly to a support, such as a davit.

DESCRIPTION OF PREFERRED EMBODIMENTS

Figure 1:
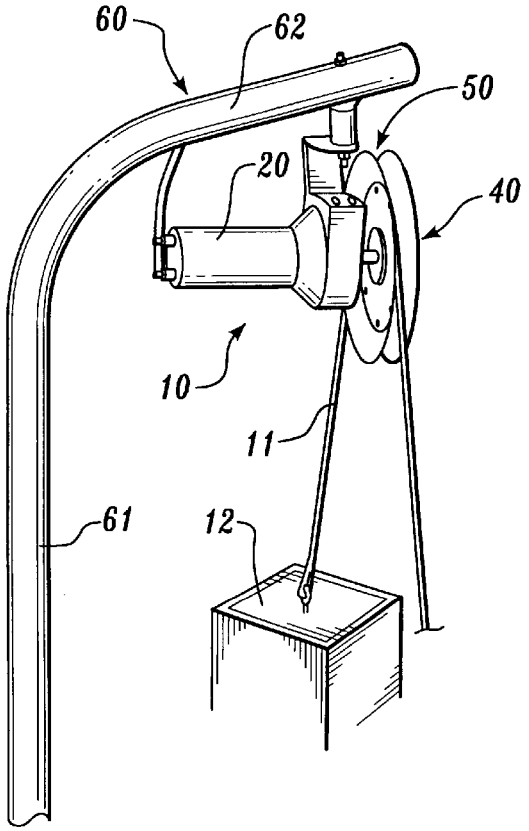
FIG. 1 shows a perspective view of a powerhead assembly of the present invention mounted on the upper portion of a davit hoisting a trap by gripping the line in the sheave assembly groove and retrieving the line by rotation of the sheave assembly.

FIG. 1 illustrates the powerhead assembly 10 of the hoisting system of the present invention comprising an electrical drive motor and gear reduction unit mounted in powerhead housing 20 for rotating sheave assembly 40. Powerhead housing 20 is mounted on the upper portion of davit 60 by means of flexible mounting joint 80. During operation, the rotational output of the gear reduction unit rotates sheave assembly 40 so that a line 11 gripped in groove 50 formed between the sheave components of sheave assembly 40 is retrieved to hoist trap 12.

Figure 3:
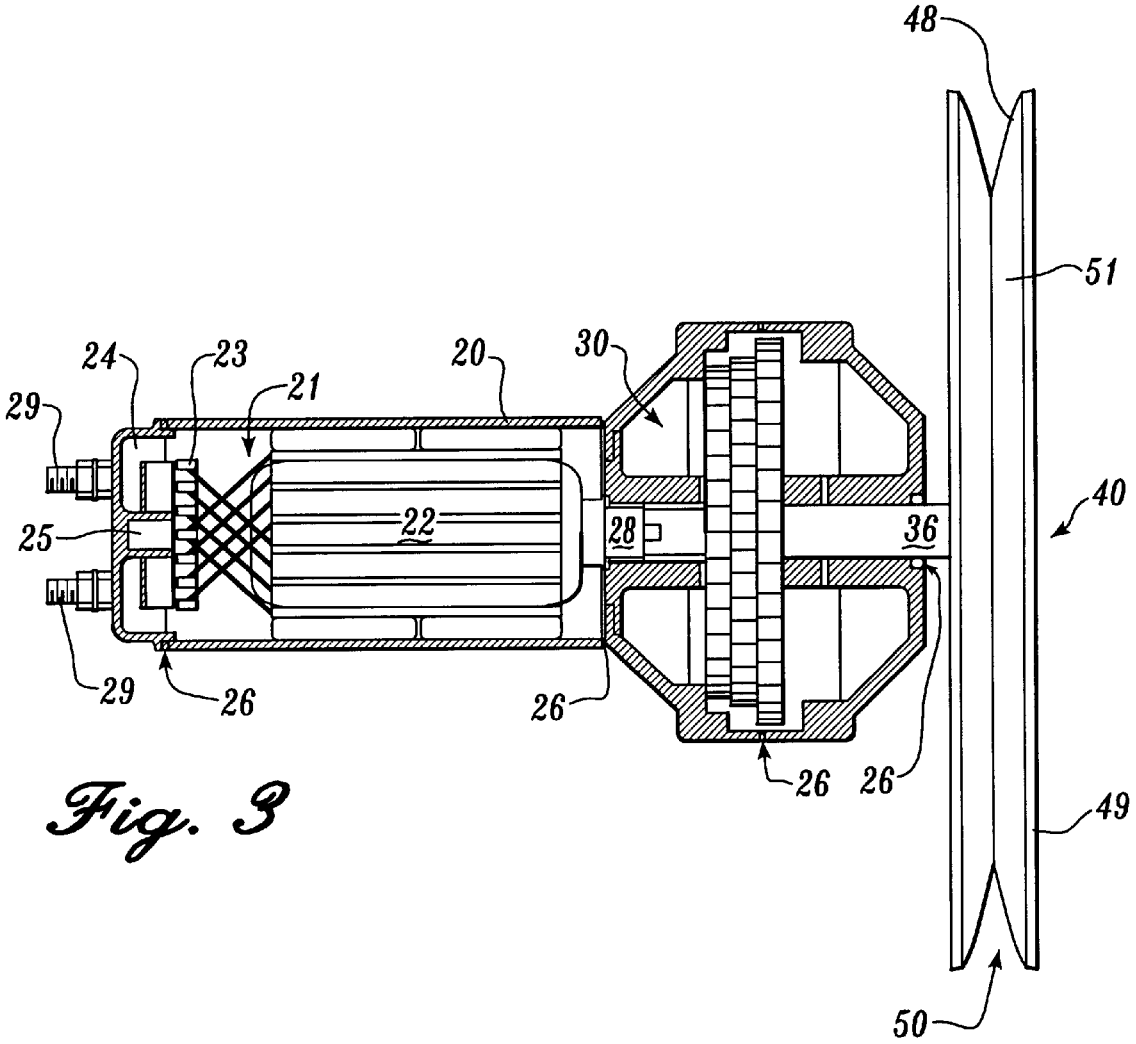
FIG. 3 shows a side, partially broken away view of the power head assembly of the present invention comprising an electrical drive motor, a gear reduction unit and a sheave assembly.

FIG. 3 shows a broken away view of powerhead housing 20 housing electrical drive motor 21 and gear reduction unit 30. Electrical drive motor 21 preferably comprises a 4 pole permanent magnet 12 volt DC electric motor. Electric drive motors of various sizes and types may be used, depending upon the output rotational speed and torque required for various applications. Electrical drive motors having a high torque design suitable for use in intermittent usage applications are preferred.

As shown in FIG. 3, a preferred embodiment comprises motor armature 22 operatively connected to face style commutator 23 mounted in brush assembly and motor end cap 24 through bushing 25. Terminals 29 provide for electrical connection of drive motor 21 to an external power source. Output drive shaft 28 delivers the rotational drive motor output. Drive motor armature 21 is rotatably mounted in a watertight condition in motor casing 20. Water-tight O-ring seals 26 are preferably provided at locations where the casing 21 is not continuous. A 2.1 horsepower, 12 volt DC electrical motor drawing 30–80 amps available from United Technologies, Columbus, Mississippi as Model No. 5276920 M030MM 12V is preferred for use in hoisting systems for commercial applications. A 0.7 horsepower, 12 volt DC electrical motor drawing 15–40 amps is preferred for use in hoisting systems for recreational applications. Since each hoisting operation requires operation of the motor for just a few minutes, a conventional 150 amp/hour marine 12 volt battery provides at least 60 hoists without recharging.

Output drive shaft 28 engages gear reduction unit 30 to slow the rotational speed and to increase torque output. Various types of gear reduction units are capable of handling the torque output; the drive assembly must also be capable of holding the load when the motor is switched "off." The desired gear reduction ratio is suitably between about 30:1 and about 160:1 and preferably between about 50:1 and 135:1. Various types of gear reduction units are well known in the art and may be utilized. Planetary differential gear arrangements and multiple spur gear reduction units are preferred for use with in-line axial motor output shafts. A planetary differential gear design comprising castings manufactured from a lightweight metal, such as aluminum, is preferred to reduce overall weight and provide corrosion resistance.

Gear reduction output shaft 36 is provided with means for rigidly and detachably mounting sheave assembly 40. A preferred embodiment is illustrated in FIG. 4C and utilizes a woodruff key arrangement for mounting to sheave assembly 40 through flange 37. Flange 37 comprises an inner mounting portion 38 sized to fit snugly in central bores of the sheave components and outer rim 39 through which fasteners are received for mounting to the sheave components.

Sheave assembly 40 is rigidly mounted on gear reduction output shaft 38 through flange 37. As shown in FIGS. 4A, 4B and 4C, sheave assembly 40 preferably comprises two sheave components 42 mounted in a mirror image relationship to form groove 50 for to receiving and gripping line as it is retrieved during a hoisting operation. Sheave components 42 are preferably circular and are provided with a central bore 43 sized for mounting on inner mounting portion 38 of flange 37, and bores 44 in proximity to central bore 43 for receiving fasteners to fasten the sheave components to outer rim 39 of flange 37. Each sheave component 42 has a sheave interface surface 45 that is generally planar between central bore 43 and annular edge 46. A plurality of through holes 47 are provided in interface surface 45, preferably in proximity to annular edge 46 for receiving fasteners to rigidly mount two sheave components together to form a sheave assembly.

Peripheral rim 48 is tapered at an angle A from the plane of interface surface 45 to peripheral edge 49. Adjacent peripheral rims 48 for sheave groove 50 when the sheave components are mounted to one another. The desired taper angle A may vary depending upon desired characteristics of groove 50. According to preferred embodiments, taper angle A is from about 5° to about 25°, and most preferably is about 15°. The desired width of peripheral rim 47 may likewise vary depending upon the desired characteristics of groove 50 and the size, type or composition of line intended for use with the hoisting system. Peripheral rim 48 is preferably from about ½" to about 3 inches wide.

Sheave components 42 are preferably constructed from a uniform thickness of a rigid, corrosion-resistant material such as stainless steel. Sheave components having a uniform thickness generally provide a desirably light weight assembly. The inner surface of each sheave component is preferably provided with resilient gripping surface 51. Natural and synthetic compounds having rubber-like properties are suitable. A material having a hardness of about 40 to about 100 durometer is suitable, with a hardness of about 80 durometer being preferred.

Gripping surface 51 is preferably sized to be mounted on interface surface 45 and peripheral rim 48 and may be fastened to surfaces of sheave component 42 using adhesive compounds. According to an especially preferred embodiment, a neoprene layer having a thickness of about 1/32" to about ¼" and a hardness of about 80 durometer is bonded to the interface surface 45 and peripheral rim 48 of sheave components 42 using a contact cement composition such as DAP Weldwood. The gripping surface may be bonded to the sheave component by applying the bonding agent, then rolling and clamping under pressure.

Two sheave components 42 are then assembled with their interface surfaces abutting, as illustrated in FIG. 4B, and removably attached to one another in a fixed, non-rotatable condition. A sheave assembly comprising two sheave components having peripheral rims 48 approximately 1⅝ inches wide, a taper angle A of about 15°, and having a gripping surface comprising a 1/16 inch layer of 80 durometer neoprene reliably grips and retrieves lines of various types having diameters of from about 1/16 into to about 1 inch.

A combination of factors, including the friction created between the resilient gripping surface and the precise angle of the groove, provide a firm gripping action on the line being hoisted. A line can be seated in the groove of the sheave assembly with a slight tug, and the gripping action continues during operation of the hoisting system until the line is removed from the sheave assembly. As the load is retrieved, line is continually fed to and released from the groove of the sheave assembly as the sheave components rotate. The line does not become wedged within the groove, and no splitter mechanism is required to separate the line from the groove. The free end of the line released from the groove is self tailing. The gripping and self-tailing features of the sheave assembly provide hands-free operation during hoisting operations and the overhead location of the powerhead assembly substantially eliminates the possibility of hand injuries.

Sheave assembly 40 may be used in combination with an optional roller fairlead, as shown in FIG. 7. The roller fairlead comprises incoming roller 52 and tailing line roller 53 rigidly mounted to sheave assembly 40. The dimensions and placement of rollers 52 and 53 are such that the incoming line is fed to sheave groove 50 and the free line is tailed to an on-board location. Suitable roller fairleads are well known in the art.

The sheave assembly of the present invention has application outside of the preferred embodiments of hoisting systems of the present invention. It may advantageously be used, for example, in hoisting systems having a variety of power sources and for various applications.

The hoisting system of the present invention preferably utilizes an electric drive motor. Electrical power is provided to drive motor 21 from an on-board 12 volt battery, and voltage to drive motor 21 is controlled by a switch mechanism providing at least on and off operation selectably by the operator. Arrangements utilizing different types of switches and control mechanisms are illustrated in FIGS. 5 and 6.

Figure 5:
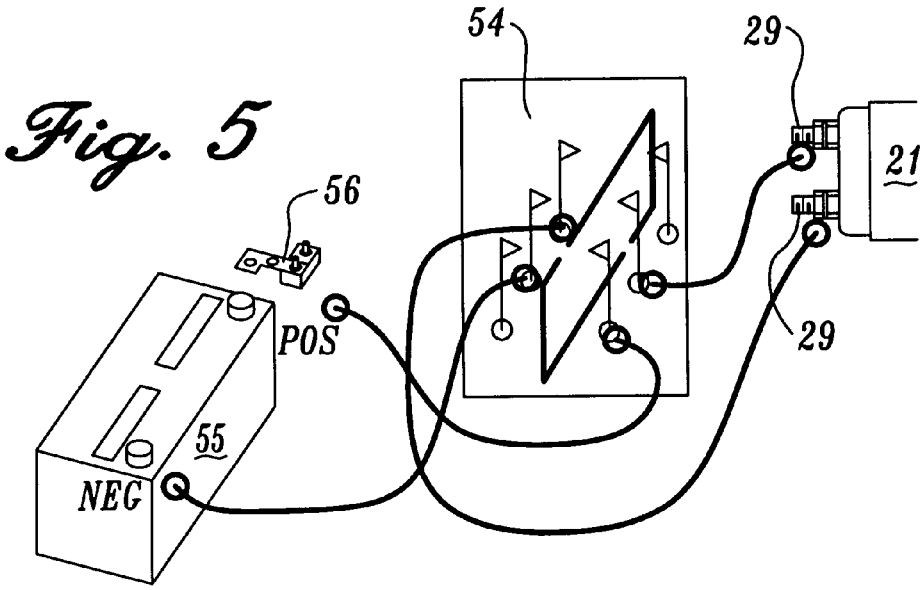
FIG. 5 shows a schematic diagram of an electrical connection of the electrical hoisting motor to a battery operable through a drum switch.

FIG. 5 illustrates an embodiment in which terminals 29 of drive motor 21 are electrically connected to drum switch 54 which, in turn, is electrically connected to 12 volt battery 55.

Various types of drum switches 54 are suitable. A lever activated rotary drum switch having three selectable positions allowing forward, hold and reverse operation of drive motor 21 is preferred. A drum switch identified as model no. 2X440A available from Dayton Electrical Mfg. Co. in Niles, Il. is preferred. The drum switch is preferably mounted in a convenient location on the vessel in proximity to the mounting location of the powerhead assembly and at a convenient location for operator control. Circuit breaker 56 having a capacity of 40 amps is mounted on the battery terminal and protects the powerhead assembly, switch and wiring harness from overload and short circuits.

Figure 6:
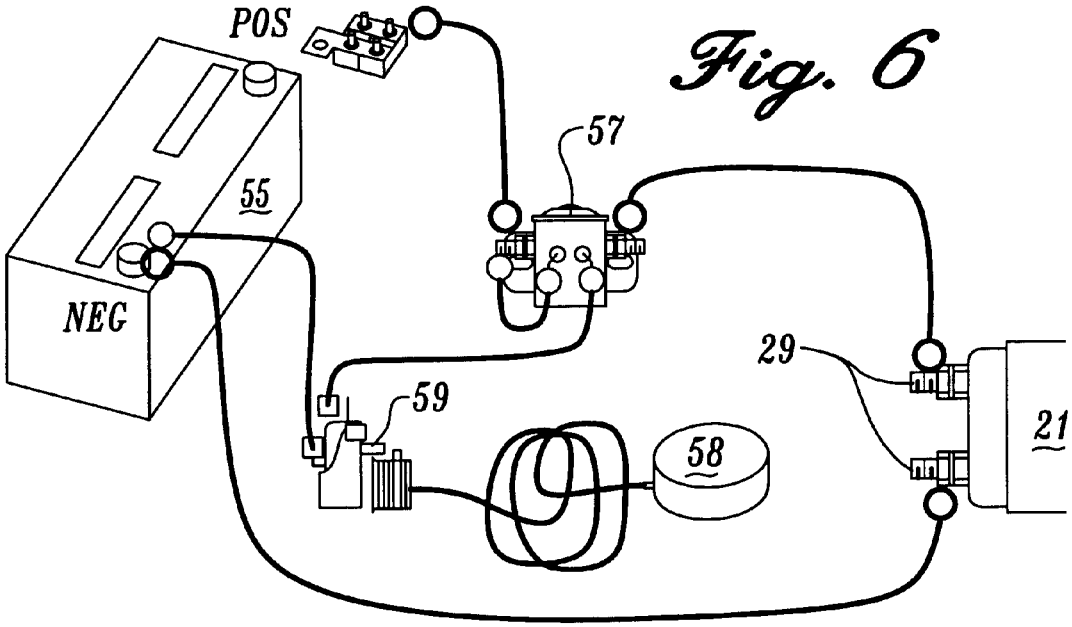
FIG. 6 shows a schematic diagram of an electrical connection of the electrical hoisting motor to a battery solenoid actuatable by means of a foot bellows.

FIG. 6 shows an alternative drive motor switch arrangement, wherein one terminal 29 of drive motor 21 is electrically connected to the negative terminal of battery 55 and the other terminal of drive motor 21 is electrically connected to solenoid 57 activated by air foot bellows 58 operating micro-switch 59. This configuration allows only single direction operation, but removes all DC voltage from the deck area, where possible saltwater intrusion may be problematic. Circuit breaker 56 mounted on the battery terminal protects the powerhead assembly, switches and wiring harness from overload and short circuits.

Alternatively, voltage to the drive motor may be controlled by a foot operated rocker switch which permits bi-directional operation. Suitable rocker switches have an interlock allowing voltage to be applied in only one direction at a time, and are sealed from the environment.

Electrical wires providing connections to drive motor terminals 29 are preferably bundled in cable 13, which is lead from terminals 29, introduced into a hollow interior portion of davit 60 in proximity to powerhead assembly 10, then exits from a lower portion of davit 60 for connection to the voltage control switch and 12 volt power source.

Powerhead assembly 10 may be mounted on any suitable support that conveniently positions sheave assembly 40 for receiving a line to be retrieved, with an incoming line being retrieved from an overboard location and the free or tailed end of the line being released from sheave assembly 40 and collected on-board. Powerhead assembly 10 is preferably mounted at or slightly above eye level of the operator and slightly outboard from a vessel gunnel on a davit or similar support structure.

Figure 2:
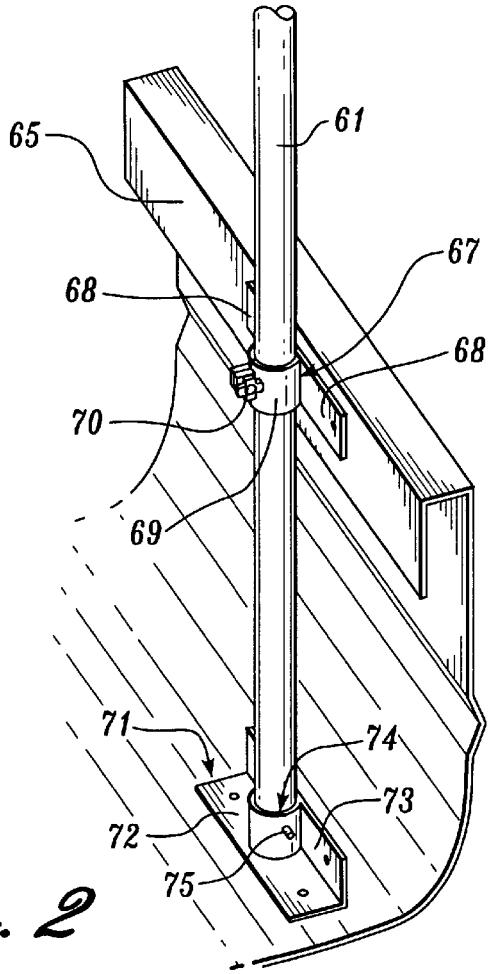
FIG. 2 shows a perspective view of the lower portion of the davit shown in FIG. 1, mounted in brackets mounted on the vessel gunnel and deck.

A preferred davit assembly 60 is illustrated in FIGS. 1 and 2, and a reinforced davit structure designed for use in heavy duty applications is illustrated in FIG. 7. Davit 60 preferably comprises a lower axial portion 61 mounted to the vessel or other support structure and an upper mounting portion 62 to which powerhead assembly 10 is mounted. The davit is preferably angled or bent so that upper mounting davit portion 62 provides a mounting location for powerhead assembly 10 that is spaced laterally from axial portion 61 of the davit, and adjustable in an outboard location. Upper mounting portion 62 of the davit preferably extends for a length sufficient to mount powerhead assembly in an outboard location with respect to the vessel gunnel. In general, the powerhead assembly 10 is desirably mounted from about two to three and a half feet outboard from axial davit portion 61. In a simplified and preferred embodiment, a unitary, one-piece davit is bent to form and position upper davit portion 62, as shown in FIG. 1. Many other arrangements would also be suitable.

Davit 60 is preferably constructed from a corrosion-resistant, rigid material such as an aluminum alloy, stainless steel alloy or galvanized steel. Tubing having a diameter of from about 1 to three inches is generally suitable. Schedule 40 and Schedule 80 aluminum pipe is especially preferred. FIG. 7 shows a davit 60 having reinforcing bar 63 mounted between axial davit portion 61 and upper mounting portion 62. A solid gusset web may also be suitable.

FIG. 2 illustrates preferred means for mounting davit 60 to a vessel gunnel and deck. Axial portion 61 of davit 60 is mounted to the vessel, preferably at one or more locations at or near the vessel gunnel 65 and at or near the vessel deck 66. The vessel gunnel may be provided with a through hole or cavity for receiving and retaining axial davit portion 61. If axial portion 61 is passed through a gunnel through hole, it is preferably mounted in a bracket on the vessel sidewall or deck to stabilize the davit and prevent rotational movement during operation.

Axial davit portion 61 is preferably mounted to the inboard sidewall of vessel gunnel 65 using mounting bracket 67. Mounting bracket 67, as illustrated in FIG. 2 is a clamping type of bracket and comprises two components, each having a mounting plate 68 adapted for rigid mounting to the vessel gunnel or other support surface. Mounting plate 68 is preferably integral with clamping surface 69, which matches the configuration of and is sized to snugly hold axial davit portion 61 in combination with a matching clamping surface. The two complementary components of mounting bracket 67 are positioned to receive axial davit portion 61 between clamping surfaces 69. The interior clamping surfaces 69 may be lined with a smooth, non-metallic material, such as a plastic sleeve, to grip and firmly retain axial davit portion 61 between the clamping surfaces and prevent rotation.

Mounting bracket 67 is preferably adjustable to permit mounting and removal, as well as selectable rotational positioning of axial davit portion 61. A fastener 70 may be provided on flanges or extensions of clamping surface 69 to provide release and tightening of clamping surfaces 69, thereby providing repeatable release and secure mounting of axial davit portion 61 in mounting bracket 67. Fastener 70 may be a clamping type of fastener, a threaded fastener, or another type of fastener that provides releasing and tightening of clamping surfaces 69 relative to one another.

Axial davit portion 61 may also or alternatively be mounted in a lower bracket 71, as illustrated in FIG. 2. According to a preferred embodiment, lower bracket 71 has adjacent integral mounting plates 72 and 73 for mounting to adjacent vessel surfaces at the interface of the vessel deck with the sidewall. Lower bracket 71 has a davit receiving portion 74 sized and configured to snugly receive and engage axial davit portion 61. A locking pin 75 for securing the davit in a fixed rotational position is preferably used in connection with lower bracket 71. Locking pin 75 is passed through matching through holes in davit receiving portion 74 of bracket 71 and axial davit portion 61 to prevent rotational movement of davit 60. A plurality of positioning through holes may be provided in axial davit portion 61 to provide locking of the davit in a plurality of rotational positions.

Powerhead housing 20 is preferably mounted to the upper mounting portion 62 of davit 60 to permit rotation of the powerhead assembly on a generally horizontal plane, and to permit a limited degree of side to side movement of the powerhead assembly. Movement of the powerhead assembly is important so that the sheave assembly can move to accommodate the direction of the incoming line being retrieved and prevent the line from jumping out of the sheave groove when the load is being hoisted from off to one side.

FIG. 8 illustrates a preferred flexible mounting joint 80 and mounting bracket 79 for mounting the powerhead assembly to the davit. Mounting bracket 79 has opposing mounting portions adapted for mounting to joint 80 and powerhead casing 20. The opposing mounting portions of mounting bracket 79 are separated by an extension arm which serves as an extension to position the powerhead casing 20 and sheave assembly 40 a suitable distance below the davit and flexible mounting joint.

Mounting joint 80 preferably comprises interlocked eyebolts 81 and 82, upper eyebolt 81 mounted through davit 60 and lower eyebolt 82 mounted through mounting bracket 79. Eyebolts 81 and 82 are rigidly mounted to the davit and mounting bracket, respectively, by bolts retained on threaded portions, or by other rigid mounting means. The interlocked relationship of eyebolts 81 and 82 permits rotation of the mounting bracket and davit with respect to one another on a horizontal plane, and permits the mounting bracket and attached powerhead assembly to swing out of the horizontal plane.

Interlocked eyebolts 81 and 82 are enclosed by means of a cover 83, such as a washer, and a sidewall enclosure 84 forming a continuous, preferably cylindrical surface. Enclosure 84 abuts cover 83 and mounting bracket 79 to snugly enclose and protect the interlocked eyebolts. Enclosure 84 preferably comprises a stiff, but flexible material that permits rotation of the eyebolts with respect to one another in the horizontal plane and permits limited swinging out of the horizontal plane. According to preferred embodiments, enclosure 84 comprises a length of tubing constructed from a corrosionresistant, resilient and somewhat flexible material such as a natural or synthetic rubber material, or a flexible thermoplastic material. Heavy duty neoprene tubing is an especially preferred material.

When the hoisting system of the present invention is used in marine applications, precautions are taken to protect the components from corrosion and wear. Components such as the drive motor, gear reduction unit, electrical switches and controls, and wiring are enclosed in a water-tight, corrosion-resistant fashion. To the extent possible, all components exposed to the environment are constructed from corrosion- and wearresistant materials, such as stainless steel and aluminum. Suitable corrosion-resistant materials and means for protecting internal components are known in the art.

In operation, powerhead assembly 10 of the hoisting system is mounted on a suitable support, such as davit 60, and electrically connected, via suitable switching mechanisms, to a 12 volt DC power source, such as a battery. A line attached to the load desired to be hoisted is lead into groove 50 in the sheave assembly. Voltage to the drive motor is initiated using the switching mechanism, and the drive motor rotates to rotate the sheave assembly and thereby retrieve the line. The sheave assembly provides hands-off, self-gripping and self-tailing operation. The electrical drive motor provides quite, exhaust-free operation and instant starting and forward and hold positioning.

Preferred embodiments of the hoisting system of the present invention have been described with reference to preferred embodiments designed for marine hoisting applications. The hoisting system described herein, and various features and components thereof, have numerous applications in addition to marine hoisting applications.

I claim:

1. A powerhead assembly for use in a hoisting system comprising:

an electrical drive motor having a drive motor output shaft and capable of producing rotation of the drive motor output shaft;

a gear reduction unit having a gear reduction output shaft, the gear reduction unit being engaged with the drive motor output shaft and capable of producing rotation of the gear reduction output shaft at a slower rotation and higher torque than the rotation of the drive motor output shaft;

a housing enclosing the electrical drive motor and the gear reduction unit and additionally comprising a mounting joint mountable to the housing and to a support structure for mounting the powerhead assembly to the support structure, the mounting joint permitting rotation of the powerhead assembly on a generally horizontal plane and limiting swinging of the powerhead assembly out of the horizontal plane; and a sheave assembly comprising two sheave components, each having a resilient gripping surface, mounted on the gear reduction output shaft in a mirror image relationship and adjacent to one another to form a groove for receiving and gripping a line during a hoisting operation.

2. A powerhead assembly according to claim 1, wherein the electrical drive motor comprises a 4 pole permanent magnet 12 volt DC motor.

3. A powerhead assembly according to claim 1, wherein the gear reduction unit provides a gear reduction ratio of from about 50:1 to about 135:1.

4. A powerhead assembly according to claim 1, wherein rotational output of the gear reduction output shaft, during operation of the electrical motor, is from about 20 to 100 rpm.

5. A powerhead assembly according to claim 1, wherein the torque output of the gear reduction output shaft, during operation of the electrical motor, is from about 100 to about 500 ft. lbs.

6. A powerhead assembly according to claim 1, wherein each sheave component comprises a planar interface surface and an adjacent peripheral rim tapered at an angle of about 15° from the planar interface surface.

7. A powerhead assembly according to claim 6, wherein the peripheral rim of each sheave component is about ½ inch to about 3 inches wide.

8. A powerhead assembly according to claim 6, wherein the resilient gripping surface is provided on each planar interface surface and adjacent peripheral rim.

9. A powerhead assembly according to claim 1, wherein each of the sheave components has a substantially uniform thickness.

10. A powerhead assembly according to claim 1, wherein the resilient gripping surface of each of the sheave components has a hardness of from about 60 to about 100 durometer.

11. A powerhead assembly according to claim 1, wherein the resilient gripping surface of each of the sheave components comprises neoprene.

12. A powcrhead assembly according to claim 1, wherein the mounting joint comprises upper and lower interlocked eyebolts and an enclosure comprising a stiff but flexible material that permits rotation of the eyebolts with respect to one another in the horizontal plane and limits swinging of the powerhead assembly out of the horizontal plane.

13. A hoisting system comprising:

an electrical drive motor capable of producing rotation of a drive motor output shaft a motor casing enclosing the electrical drive motor and additionally comprising a mounting joint for mounting the motor casing to a support structure that permits rotation of the motor casing in a generally horizontal plane and that limits swinging of the motor casing out of the horizontal plane; and a sheave assembly comprising two sheave components having resilient gripping surfaces mounted in a mirror image relationship to one another to form a groove having resilient gripping surfaces for receiving and gripping a line during a hoisting operation, the sheave assembly adapted to be rotated by rotational output of the drive motor.

14. A hoisting system according to claim 13, wherein the drive motor is a 12 volt DC electrical drive motor, and the system additionally comprises a switch mechanism electrically connected to the drive motor to control power to the drive motor and thereby permit controllable operation of the hoisting system.

15. A hoisting system according to claim 14, wherein the switch mechanism has three selectable positions allowing forward, hold and reverse operation of the drive motor.

16. A hoisting system according to claim 13, wherein the electrical drive motor is enclosed in a motor casing, and additionally comprising a davit having a lower axial portion mountable to a support structure and an upper mounting portion to which the motor casing is mountable.

17. A hoisting system according to claim 13, wherein the resilient gripping surface of each of the sheave components comprises neoprene.

* * * * *